US009491977B2

(12) United States Patent
Marovets

(10) Patent No.: US 9,491,977 B2
(45) Date of Patent: Nov. 15, 2016

(54) COUGH CATCHER

(71) Applicant: Jack L. Marovets, Cedar Rapids, IA (US)

(72) Inventor: Jack L. Marovets, Cedar Rapids, IA (US)

( * ) Notice: Subject to any disclaimer, the term of this patent is extended or adjusted under 35 U.S.C. 154(b) by 0 days.

(21) Appl. No.: 14/267,535

(22) Filed: May 1, 2014

(65) Prior Publication Data

US 2014/0325738 A1 Nov. 6, 2014

Related U.S. Application Data

(60) Provisional application No. 61/818,646, filed on May 2, 2013.

(51) Int. Cl.
*A41D 19/00* (2006.01)
*A41B 15/00* (2006.01)

(52) U.S. Cl.
CPC ..... *A41D 19/0024* (2013.01); *A41D 19/0082* (2013.01); *A41B 15/00* (2013.01); *A41D 2400/34* (2013.01)

(58) Field of Classification Search
CPC ..... A41D 19/0075; A41D 19/0006; A41D 2400/34; A41D 13/081; A41D 19/0013; A41D 19/0017; A41D 19/002; A41D 19/0024; A41D 19/0055; A41D 19/0068; A41D 19/015; A41D 19/01594; A41D 19/0082; A47L 13/19; A41B 15/00; A41B 2400/34
USPC ..... 2/20, 159, 161.7, 167; 15/227, 229.11; 401/7; 424/404
See application file for complete search history.

(56) References Cited

U.S. PATENT DOCUMENTS

| | | | | | |
|---|---|---|---|---|---|
| 1,351,311 | A * | 8/1920 | Virneburg | A47K 7/03 | 15/227 |
| 2,265,329 | A * | 12/1941 | Wachs | A47K 7/03 | 15/227 |
| 3,736,926 | A * | 6/1973 | Irby | A61F 5/37 | 128/879 |
| 4,347,931 | A * | 9/1982 | Ginger et al. | 206/438 | |
| 5,196,244 | A * | 3/1993 | Beck | 428/35.2 | |
| 5,864,883 | A * | 2/1999 | Reo | 2/158 | |
| 6,398,443 | B1 * | 6/2002 | Barela | 401/201 | |
| 7,581,273 | B2 * | 9/2009 | Dobrin et al. | 15/104.94 | |
| 7,584,519 | B2 * | 9/2009 | Ouellette et al. | 15/227 | |
| 7,690,050 | B2 * | 4/2010 | Stockhamer | 2/69 | |
| 8,091,552 | B2 * | 1/2012 | Stockhamer | A61F 13/122 | 128/206.19 |
| 8,910,312 | B1 * | 12/2014 | Apisa | 2/59 | |
| 2004/0083530 | A1 * | 5/2004 | LeVert | A41D 13/082 | 2/159 |
| 2005/0111898 | A1 * | 5/2005 | Barton et al. | 401/7 | |
| 2007/0086828 | A1 * | 4/2007 | Stewart | A47L 13/19 | 401/7 |
| 2009/0053274 | A1 * | 2/2009 | Thomson | 424/402 | |
| 2011/0047671 | A1 * | 3/2011 | Zhu | 2/161.8 | |
| 2011/0088132 | A1 * | 4/2011 | McNamee-Sollars | 2/46 | |
| 2011/0131702 | A1 * | 6/2011 | Rodgers | A41D 19/002 | 2/158 |
| 2012/0066816 | A1 * | 3/2012 | Starr | 2/243.1 | |

* cited by examiner

*Primary Examiner* — Amy Vanatta
(74) *Attorney, Agent, or Firm* — Goodhue, Coleman & Owens, P.C.

(57) ABSTRACT

A cough catching apparatus includes a body for securing to a hand of an individual, the body having an outer surface, an area on the outer surface having a material thereon, and a disinfectant infused into the material. The body may be a glove body. The glove body may have an opening for inserting a hand into the glove body and a plurality of finger openings. The area may be a palm area, a top of hand area, or may include both a palm area and a top of hand area.

8 Claims, 4 Drawing Sheets

COUGH CATCHER

CROSS REFERENCE TO RELATED APPLICATIONS

This application claims priority under 35 U.S.C. §119 to provisional applications U.S. Ser. No. 61/818,646 filed May 2, 2013, herein incorporated by reference in its entirety.

FIELD OF THE INVENTION

The present invention relates to personal hygiene. More particularly, the present invention relates to an apparatus, method, and system for improving sanitary conditions and reducing the spread of germs.

BACKGROUND OF THE INVENTION

Influenza or "the flu" as it is commonly named includes various symptoms such as coughing. Flu germs spread from person to person by ways of coughing or sneezing. Similarly, other germs may be spread in the same way.

To prevent the spread of germs, one's mouth and nose should be covered with a tissue. Of course, tissues are not always readily available when one needs to cough or sneeze. Another approach which may be used when tissue is not available to cough or sneeze into one's upper arm, elbow, or shoulder and not the hands. Doing so avoids coughing directly into the hands, but any pathogens may still be later transferred to the hands, or otherwise conveyed to others. In addition doing so may allow more germs to spread in the air to others.

The problems relating to spreading germs through coughing or sneezing is further amplified in the case of children who may be less likely to use tissue and less likely to cough or sneeze into their upper arm. Children may be inclined to cough or sneeze into their hands. Once the germs on their hands, this promotes the spread of germs unless the hands are immediately cleaned which does not necessarily happen. Thus, the spread of germs or other disease can occur quickly between children at school, at day care, or in other settings. Similar issues can occur in other settings as well, such as nursing homes, where elderly are susceptible to germs or in confined areas with large numbers of people, such as airplanes.

What is needed is an improved way of capturing coughs and neutralizing germs or other antigens.

SUMMARY OF THE INVENTION

Therefore, it is a primary object, feature, or advantage of the present invention to improve over the state of the art.

It is a further object, feature, or advantage of the present invention to reduce the spread of germs.

It is a still further object, feature, or advantage of the present invention to provide for reducing the spread of germs from children in a safe and non-toxic way.

One or more of these and/or other objects, features, or advantages of the present invention will become apparent from the specification and claims that follow. No single embodiment need meet each or every object, feature, or advantage as different embodiments may have different objects, features, or advantages.

According to one aspect, an apparatus for cough catching is provided. The apparatus includes a body for securing to a hand of an individual, the body having an outer surface, an area on the outer surface having a material thereon, and a disinfectant infused into the material. The body may be a glove body. The glove body may have an opening for inserting a hand into the glove body and a plurality of finger openings. The area may be a palm area, a top of hand area, or may include both a palm area and a top of hand area.

According to another aspect, a method for catching a cough is provided. The method includes providing an apparatus for cough catching, the apparatus having (a) a body for securing to a hand of an individual, the body having an outer surface, (b) an area on the outer surface having a material thereon, and (c) a disinfectant infused into the material. The method further includes placing the apparatus on the hand of the individual, and lifting the apparatus to the mouth of the individual to catch the cough such that the material is positioned at the mouth of the individual. The method may further include removing the apparatus from the hand of the individual after the cough, and disposing of the apparatus after removing.

DETAILED DESCRIPTION

Figure 1:
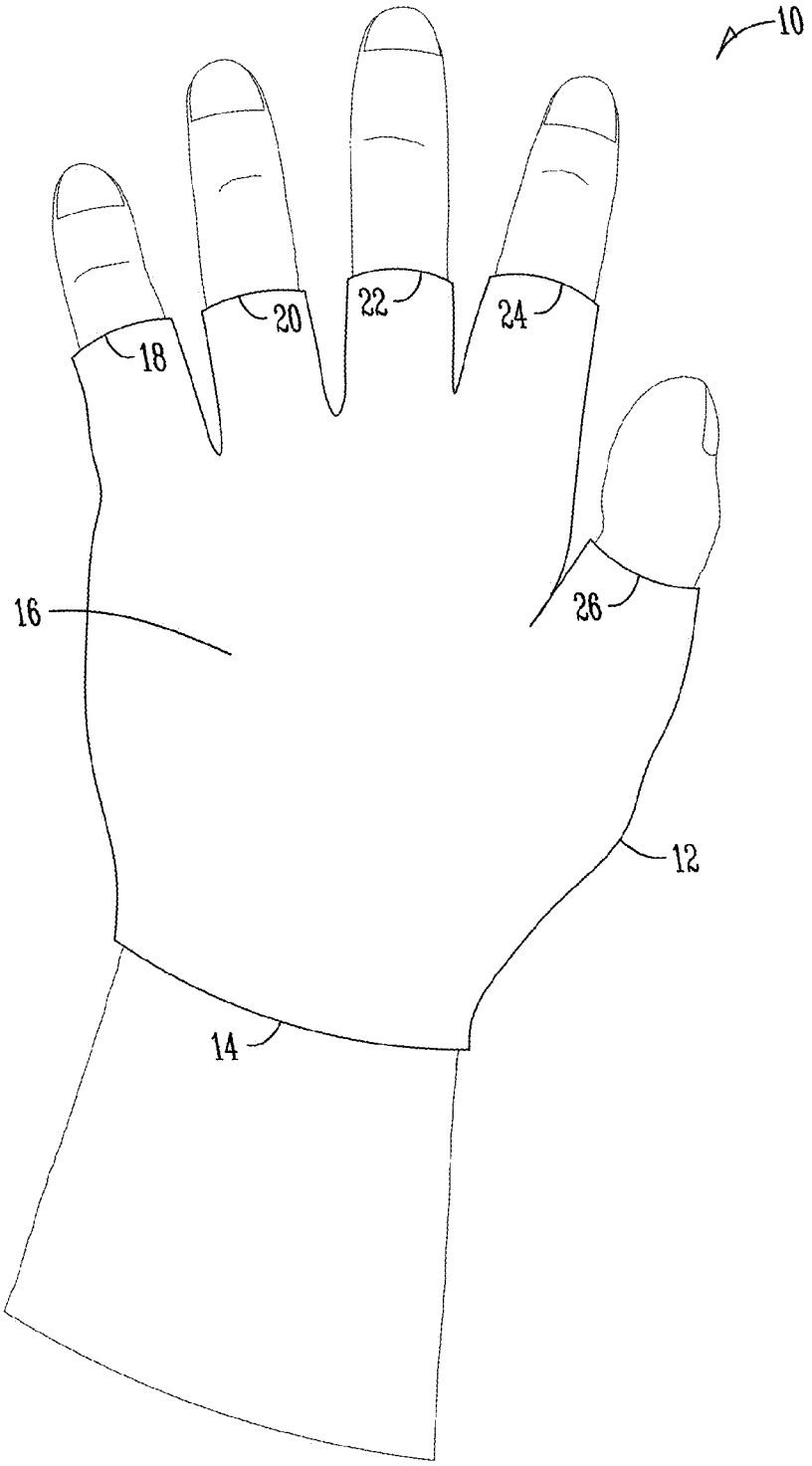
FIG. 1 illustrates one example of an apparatus on a hand of the individual showing the outside portion.
Figure 2:
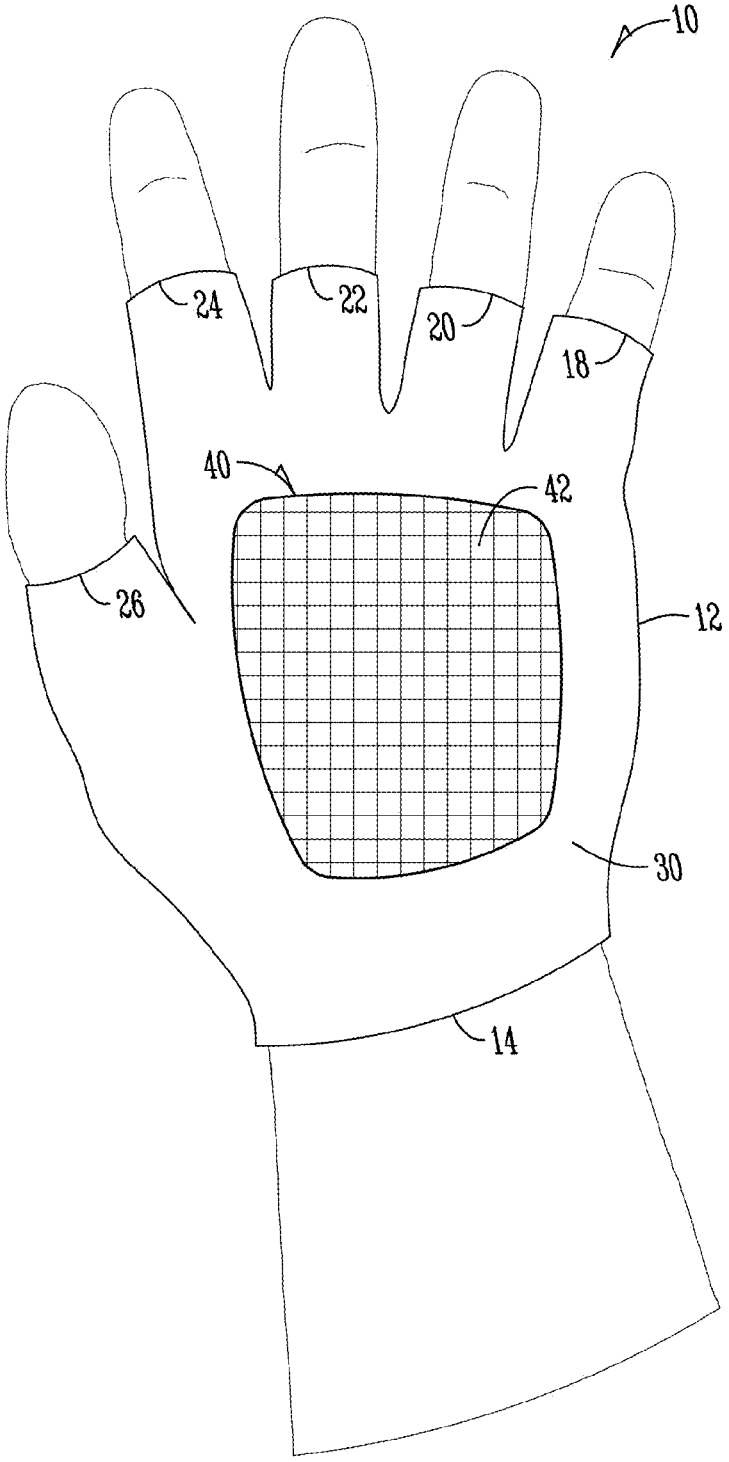
FIG. 2 illustrates the apparatus on the hand of the individual covering the palm of the individual.

The present invention provides for a device to capture germs or other material associated with coughing and/or sneezing. As shown in FIG. 1 and FIG. 2, the device or apparatus 10 may be in the form of a glove with a main body 12. The device 10 has finger portions 18, 20, 22, 24, and a thumb portion 26. As shown, the finger portions 18, 20, 22, 24, and thumb portion 26 each have an opening so that an individual's fingers and thumb may extend through the glove.

The device 10 has a front side 16 with an opening 14 at the wrist of the individual.

As shown in FIG. 2, the glove 10 has an opposite portion with a side 30 covering the palm of the individual. Positioned in a central portion of the side 30 of the glove 10 is material 40. The material 40 may include a pad which is infused with a disinfectant 42. Preferably, the disinfectant kills or neutralizes germs, pathogens or otherwise sanitizes. Preferably the disinfectant is non-toxic to humans, and safe to use. Thus, a person anticipating a cough or sneeze may hold their palm up to or over their mouth and/or nose to catch materials being released and germs.

Figure 3:
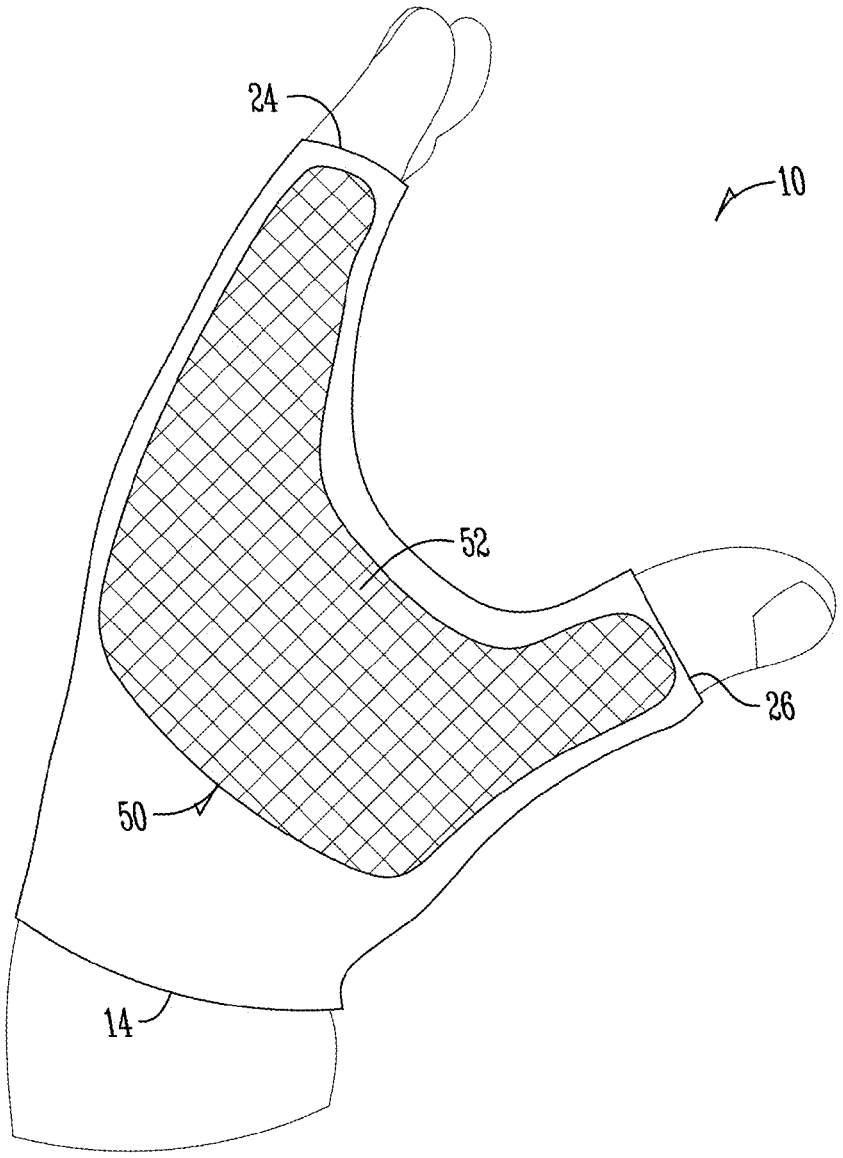
FIG. 3 illustrates an apparatus showing a top of hand of the individual.
Figure 4:
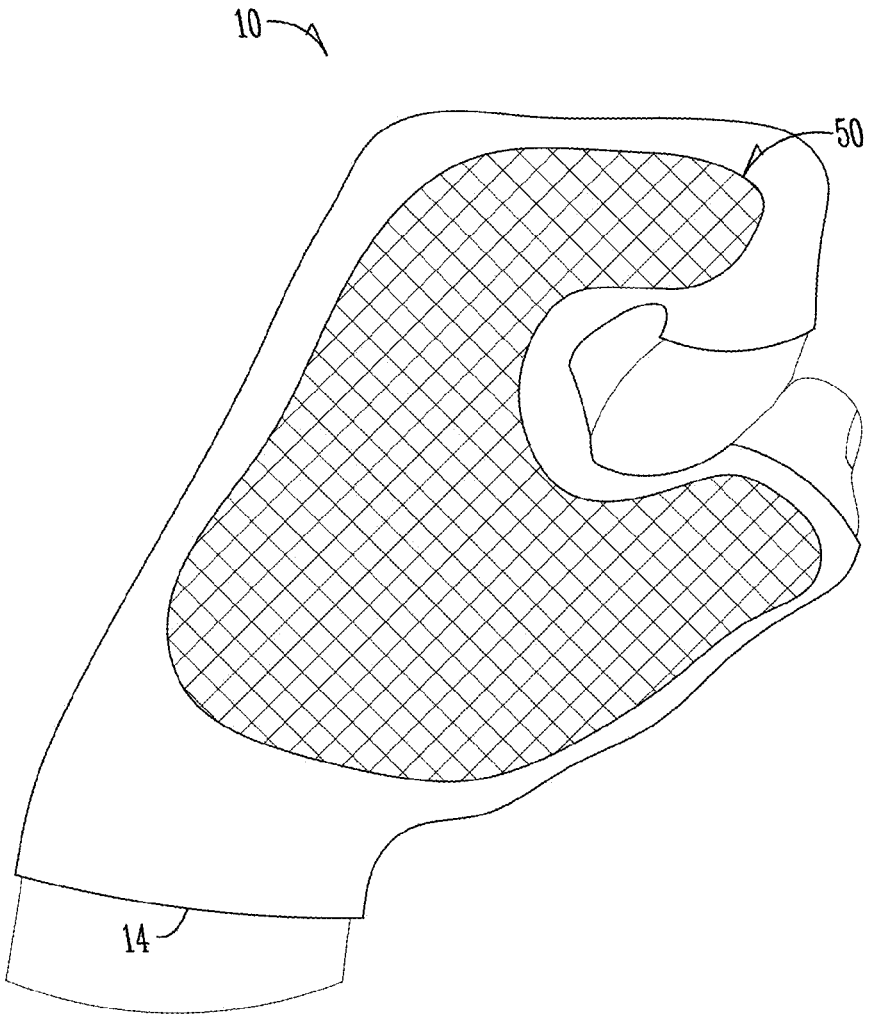
FIG. 4 illustrates the apparatus showing the hand of the individual in a closed fist.

FIG. 3 illustrates the glove 10 with material 50 positioned at the top of the hand. Note that the material 50 may be placed in this position instead of the position of material 40 in FIG. 2 or in addition to the position of material 40 in FIG. 2. Disinfectant 52 may also be infused into the material 50 to kill or neutralize germs or other pathogens or to otherwise clean or sanitize.

After each use, the glove may be removed and disposed of and replaced with another glove. The glove may be particularly beneficial with children as they would not need to find a tissue and use it.

Although particular embodiments are shown, the present invention contemplates numerous variations, options, and alternatives. For example, although shown with finger openings, such openings need not be present. The glove could be fitted on fewer than a thumb and five fingers. For example, the glove could fit over only the thumb and the fore finger. Instead of a glove, the apparatus could take the form of a strap placed around the hand.

What is claimed is:

1. An apparatus for cough catching, comprising:

a plastic disposable glove body for securing to a hand of an individual, the plastic disposable glove body having an outer surface configured to cover a palm area of the hand and an opposite back area of the hand to protect and isolate the hand from germs or antigens associated with coughing;

an area overlaying a portion of the outer surface of the plastic disposable glove body, the area having a material thereon;

a disinfectant infused into the material, wherein the disinfectant comprises a material to kill or neutralize germs or pathogens;

wherein the plastic disposable glove body comprises an opening for inserting a hand into the plastic disposable glove body;

wherein the plastic disposable glove body further comprises a plurality of finger sleeves, each of the finger sleeves having a proximal open end for inserting a finger and a distal open end such that the finger inserted into the sleeve extends through the sleeve and a tip of the finger extends beyond the sleeve when the apparatus is in an operative position fitted to the hand of the individual;

wherein the plastic disposable glove body is configured to protect and isolate the hand from germs or antigens associated with coughing which are captured at the material on the area overlaying the portion of the outer surface of the plastic disposable glove body.

2. The apparatus of claim 1 wherein one of the plurality of finger openings is a thumb opening.

3. The apparatus of claim 1 wherein the material is positioned on the outer surface of the plastic disposable glove to fit over the top of the hand area.

4. The apparatus of claim 1 wherein the material is positioned on the outer surface of the plastic disposable glove to fit over both the top of the hand area and a palm area of the hand.

5. A method for catching a cough, comprising:

providing an apparatus for cough catching, the apparatus comprising (a) a plastic disposable glove body for securing to a hand of an individual, the plastic disposable glove body having an outer surface configured to cover a palm area of the hand and an opposite back area of the hand to protect and isolate the hand from germs or antigens associated with coughing, (b) an area overlaying a portion of the outer surface of the plastic disposable glove body, the area having a material thereon, (c) a disinfectant infused into the material, (d) wherein the plastic disposable glove body comprises an opening for inserting a hand into the plastic disposable glove body, (e) wherein the plastic disposable glove body further comprises a plurality of finger sleeves, each of the finger sleeves having a proximal open end for inserting a finger and a distal open end such that the finger inserted into the sleeve extends through the sleeve and a tip of the finger extends beyond the sleeve when the apparatus is in an operative position fitted to the hand of the individual, (f) wherein the Plastic disposable glove body is configured to protect and isolate the hand from germs or antigens associated with coughing which are captured at the material on the area overlaying the portion of the outer surface of the plastic disposable glove body;

placing the apparatus on the hand of the individual; and lifting the apparatus to the mouth of the individual to catch the cough such that the padded material is positioned at the mouth of the individual and the hand is protected and isolated from the germs or antigens associated with the cough.

6. The method of claim 5 further comprising removing the apparatus from the hand of the individual after the cough.

7. The method of claim 6 further comprising disposing of the apparatus after moving.

8. An apparatus for cough catching, comprising:

a plastic disposable glove body for lifting to a hand of an individual, the plastic disposable glove body having an outer surface configured to cover a palm area of the hand and an opposite back area of the hand to protect and isolate the hand from germs or antigens associated with coughing;

the plastic disposable glove body having an opening for inserting the hand into the plastic disposable glove body and a thumb opening for extending the thumb through and four finger openings for extending the fingers through such that ends of the thumb and fingers are exposed;

a pad area overlaying a portion of the outer surface of the plastic disposable glove body formed of a padded material infused with disinfectant;

wherein the pad area is positioned over the palm area of the hand of the individual;

wherein the plastic disposable glove body is configured to protect and isolate the hand from germs or antigens associated with coughing which are captured at the pad area on the portion of outer surface of the plastic disposable glove body.

* * * * *